US006012739A

United States Patent [19]

Weiss et al.

[11] Patent Number: 6,012,739

[45] Date of Patent: Jan. 11, 2000

[54] METHOD AND APPARATUS FOR SECURING A SNOWBOARD

[76] Inventors: Jonathan Weiss, deceased, late of Longmont, Colo.; by Jill C. Weiss Lester, legal representative, 8720 N. 55th St., Longmont, Colo. 80503; James Weiss, P.O. Box 239, Pine Island, N.Y. 10969; Russell Lester, 1415 Cedar Ave., Boulder, Colo. 80304

[21] Appl. No.: 09/025,637

[22] Filed: Feb. 18, 1998

[51] Int. Cl.[7] ..... A63C 11/00

[52] U.S. Cl. ..... 280/814; 70/18; 70/58

[58] Field of Search ..... 70/18, 19, 58, 70/14, 15; 280/814, 623, 809; 211/70.5, 4; 224/323, 917, 315

[56] References Cited

U.S. PATENT DOCUMENTS

| | | | |
|---|---|---|---|
| 3,959,995 | 6/1976 | Fletcher | 70/18 |
| 3,999,409 | 12/1976 | Bell | 70/58 |
| 4,216,665 | 8/1980 | McKelvey | 70/58 |
| 4,896,519 | 1/1990 | Pitts | 70/58 |
| 5,076,531 | 12/1991 | Delaney | 248/552 |
| 5,475,993 | 12/1995 | Kuo | 70/18 |
| 5,675,999 | 10/1997 | Carlstrom | 70/18 |

*Primary Examiner*—J. J. Swann
*Assistant Examiner*—David R. Dunn
*Attorney, Agent, or Firm*—Ruth Eure

[57] ABSTRACT

A device for securing a snowboard is provided including a shackle accessory in the form of a bracket for attaching a securing mechanism, with or without a lock, to a snowboard. The bracket of the present invention collapses for ease of portability. Also provided is an alternate embodiment wherein the securing mechanism can be used as a carrying strap.

11 Claims, 2 Drawing Sheets

METHOD AND APPARATUS FOR SECURING A SNOWBOARD

FIELD OF THE INVENTION

The present invention relates to an accessory for a recreational board such as a snowboard or a surf board, for example.

BACKGROUND OF THE INVENTION

During the past few years great interest has arisen in the use of snowboards for healthful recreation. Concomitant with that interest, substantial strides have been made in the engineering and manufacturing of snowboards. As a result, high quality and lightweight snowboards have been developed and these devices are now quite popular. In turn, the costs of these devices has increased. A need has arisen to provide a method for securing these devices when unattended to discourage theft. The present invention meets this need in offering such a securing device.

Because of its light weight, compactness, and resistance to tampering and cutting, the cable, and especially the helically coiled cable, combined with a lock, is a desirable method of securing snowboards and the like to fixed structure. The present invention provides a bracket which allows the securing of the snowboard to a fixed object by use of a cable, or other means.

Heretofore, no suitable means were available for securing a snowboard to a fixed object while unattended. Prior art devices designed for skis are inadequate for securing snowboards due to dimensional differences between skis and snowboards.

U.S. Pat. No. 5,675,999 to Carlstrom presents one solution to this problem. Carlstrom provides a snowboard lock which comprises two opposing arms.

The present invention however, offers improvements to Carlstrom's device in that it is designed for greater compactibility and ease of carrying. The device of the present invention accomplishes this improvement by addition of a hinge in the securing arms thereby folding the arms. Another preferred embodiment of the present invention offers an accessory which provides a carrying strap for greater portability of the snowboard.

SUMMARY OF THE INVENTION

In view of the foregoing, it is an object of the present invention to provide a shackle accessory in the form of a bracket for attaching a securing means such as a cable, with or without a lock, to a snowboard.

It is another object of the present invention to provide such a bracket which is light weight and easy to use.

It is yet another object of the present invention to provide a bracket which folds into a convenient shape for carrying when not in use.

It is yet another object of the present invention to provide a bracket which provides ease of construction and design which lends itself to ease of attachment to and removal from the snowboard.

It is a still further object of the present invention to provide a bracket for a snowboard which also comprises a strap which can be used as a carrying handle.

It is a still further object of the present invention to provide a modified bracket for a snowboard which also comprises a cable to attach the snowboard to a fixed object which cable can also be used as a carrying strap or handle.

It is a still further object of the present invention to provide a modified bracket for a snowboard which also comprises a cable or strap to attach the snowboard to a fixed object which cable or strap can be adjustable in length to serve as a carrying strap for carrying the board over the shoulder or shortened to serve as a handle.

DETAILED DESCRIPTION

Figure 1:
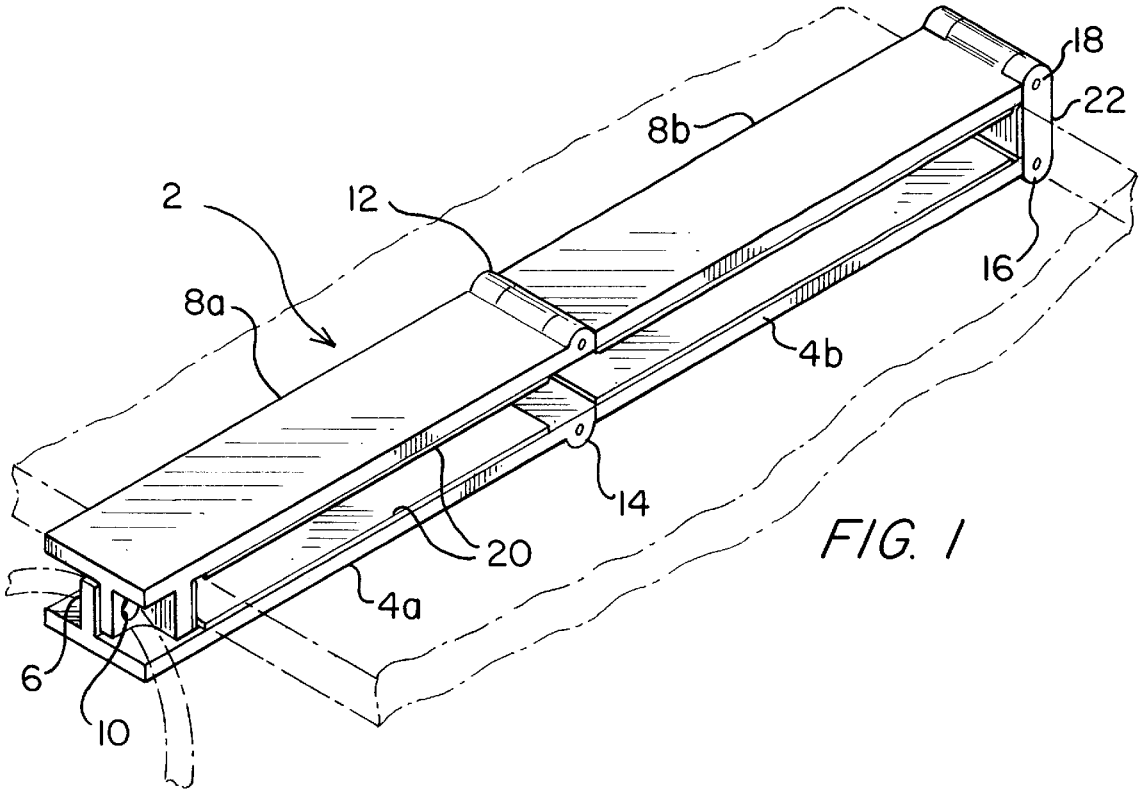
FIG. 1 shows the bracket of the present invention in use holding a snowboard in phantom.

Turning more specifically to FIG. 1, a preferred embodiment of a bracket 2 of the present invention is shown in use. A snowboard is shown in phantom. The bracket 2 of the present invention is intended to fit around the snowboard between the bindings, near the center of the board. When in use, the bracket 2 is unfolded to create locking arms which fit around the snowboard. Hinge 12 is unfolded to create locking arm 8*a*, 8*b* (referred to as locking arm 8 when in this position)and hinge 14 is unfolded to create locking arm 4*a*, 4*b* (referred to as locking arm 4 when in this position). Locking arms 4,8 are of suitable length so that the width of the snowboard will fit inside the bracket. Hinges 12 and 14 are designed to open 180 degrees. Locking arms 4 and 8 are connected to spacer 22 at hinge 18 and hinge 16, respectively. The spacer is of suitable length to accommodate the thickness of the snowboard. Hinges 18 and 16 are designed to open 180 degrees also. Holes 6, 10 are situated near the end of each locking arm, which end is opposite to the end of each locking arm which is connected to spacer 22. Holes 6, 10 are situated so as to line up when the device is in the closed position. When holes 6,10 are lined up, they can receive locking means such a coiled cable, or the like, so as to secure the snowboard to a fixed object such as a ski rack or tree, for example.

Figure 2:
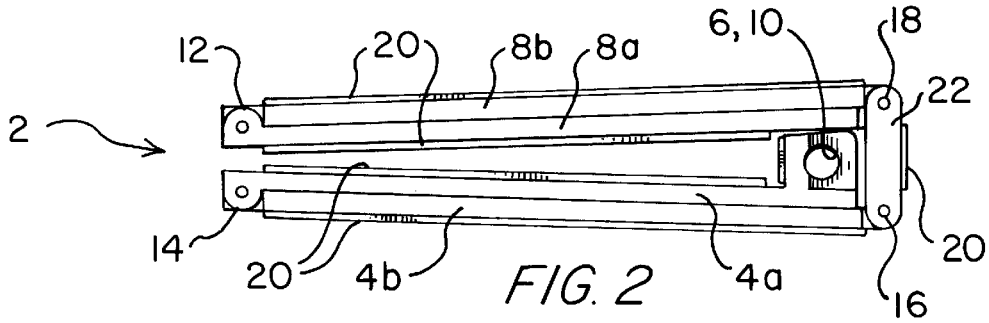
FIG. 2 shows the bracket of the present invention when fully folded, for maximum compactability and ease of portability.
Figure 3:
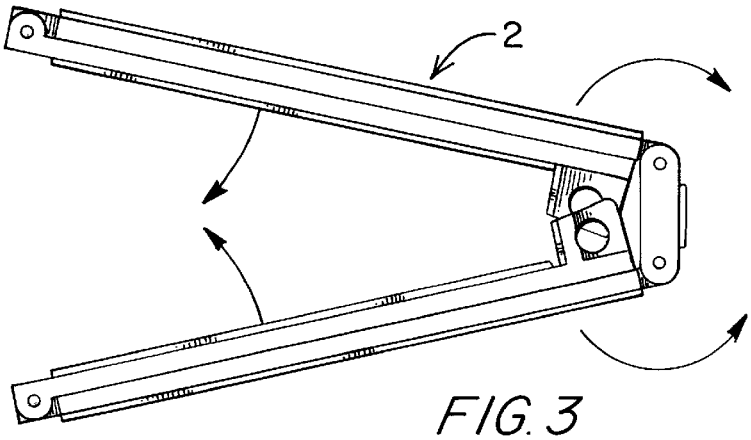
FIG. 3 shows the bracket of the present invention being unfolded from its configuration of FIG. 2 toward its configuration of FIG. 4.
Figure 4:
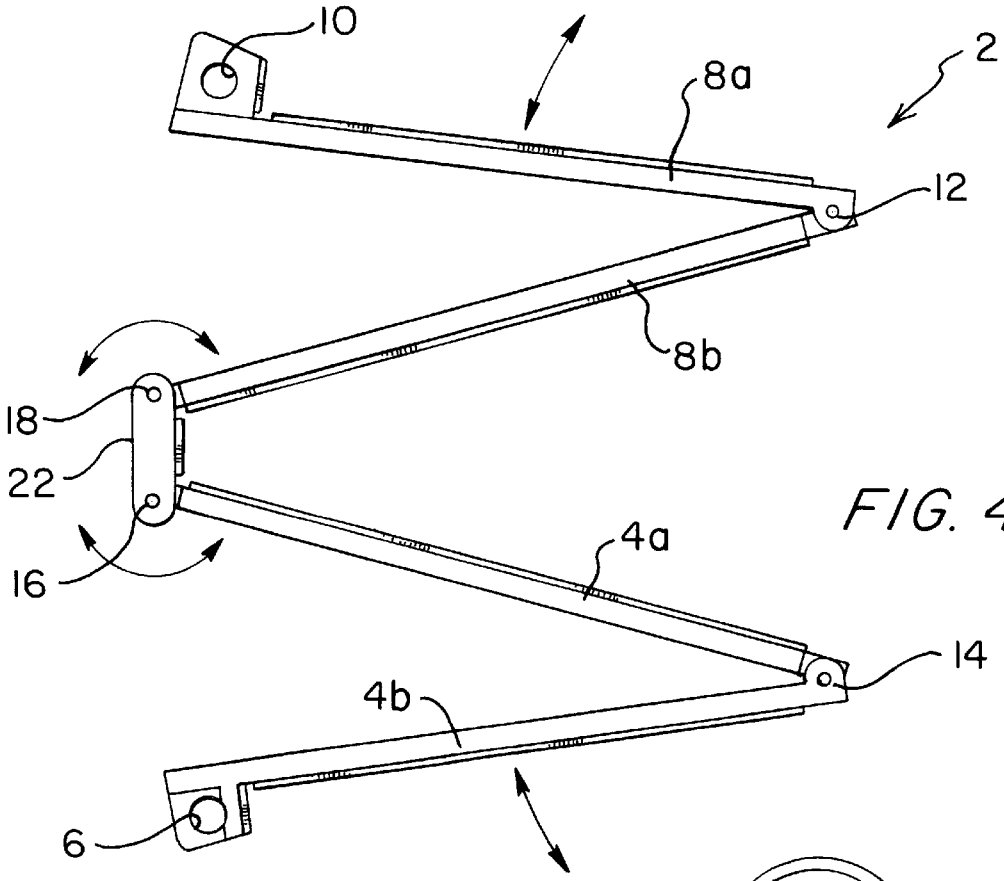
FIG. 4 shows the bracket of the present invention being further unfolded from its configuration of FIG. 3 toward its configuration of FIG. 1.

Attention is drawn to FIGS. 2, 3, and 4 to illustrate the device of the present invention when not in use. FIG. 4 shows how the bracket folds to a compact shape which facilitates portability of the device. When fully folded, the bracket is dimensioned so as to fit inside a "fanny pack" or other small personal bag. Locking arms 4 and 8 are each folded at hinges 14 and 12 respectively. Locking arm 8*a* is folded toward locking arm 8*b*, and locking arm 4*a* is folded toward locking arm 4*b*. The locking arms thus folded are then folded toward each other at hinges 18 and 16. To employ the device from the folded position, simply unfold the locking arms away from each other as indicted by the arrows in FIG. 4.

FIG. 2 illustrates the device when fully folded. FIG. 3 shows the step of unfolding the folded locking arms 4, 8 away from each other. All surfaces which are in contact with the snowboard can be covered with a layer 20 of foam or other shock absorbent material which protects the surface of the board and also serves to hold the board in frictional contact with the bracket of the present invention.

Figure 5:
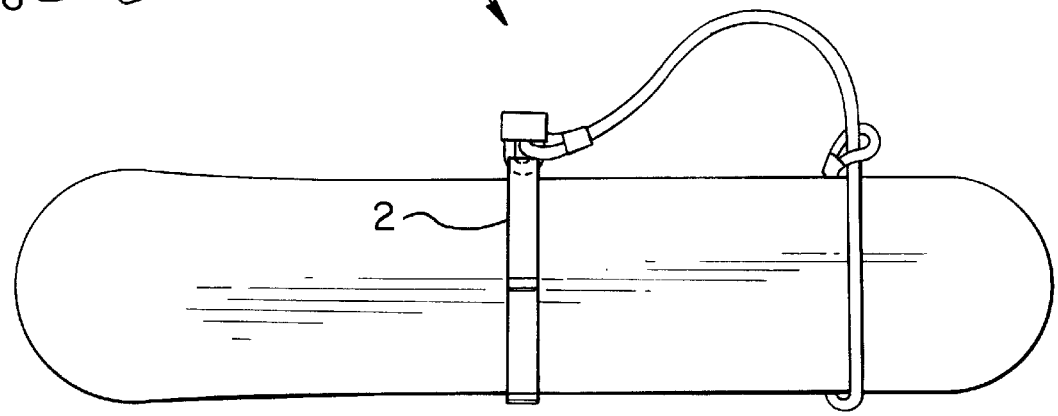
FIGS. 5 and 6 show a modified bracket of the present invention which also comprises a strap which can be used for carrying the board by a handle or over the shoulder.
Figure 6:
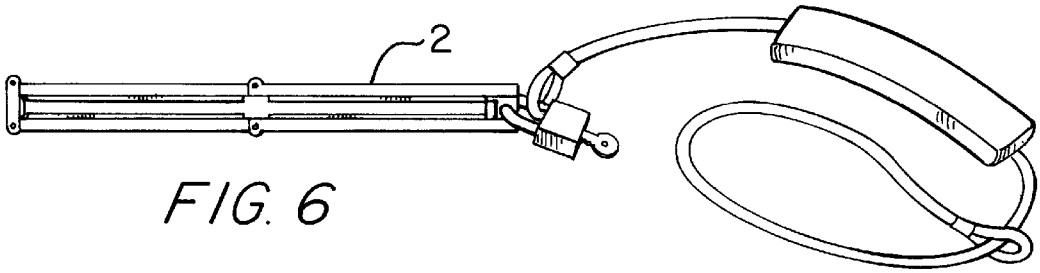

In another embodiment of the present invention a carrying strap is provided which allows the user to carry the board over the shoulder. This embodiment is shown in use in FIG. 5. FIG. 6 illustrates the component parts of this embodiment when not in use.

The bracket of the present invention may be made of any suitable material including metal, plastic or wood. Suitable metals include aluminum or steel, for example. Suitable plastics include nylon, lexan, or other thermoplastic material. To protect the board from abrasion, all surfaces which are in contact with the board should be covered with shock-absorbent material such as foam. The entire bracket can also be dip-coated in plastic, if desired.

It has therefore been shown that the present invention provides a shackle accessory for securing a snowboard, with or without a lock to a fixed object. Furthermore, it has been shown that the bracket so provided is simple in construction and design and lends itself to ease of construction, simplicity of attachment to the snowboard, and is also simple and efficient to use.

It is clear that the present invention is well adapted to carry out the objects and to attains the ends and advantages mentioned herein as well as those inherent in the invention. While the invention has been particularly shown, described and illustrated in detail with reference to specific preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

We claim:

1. A collapsible bracket for attaching a securing means to a snowboard, the collapsible bracket comprising:

(a) an upper arm and a lower arm, each arm having a hinge end and an open end;

(b) a spacer having hinges which is hingedly attached to each arm at its hinge end;

(c) the open end of the upper arm having a first aperture and the open end of the lower arm having a second aperture, the first and second aperture overlapping in a snowboard securing configuration for receiving a securing means for securing the bracket in the a securing configuration; and (d) hinge means positioned between the hinge end and the open end of both the upper arm and lower arm for collapsing the bracket into a storage configuration with the open end of the upper arm and the lower arm folding onto the hinge end of the upper arm and the lower arm, respectively, such that the first and second apertures overlap to receive the securing means for securing the bracket in the storage configuration said spacer hinges and said hinge means being parallel to each other.

2. The collapsible bracket of claim 1 wherein the surface of the bracket which contacts the snowboard is coated with shock-absorbent material.

3. The collapsible bracket of claim 2 wherein the shock absorbent material is foam.

4. The collapsible bracket of claim 1 further comprising a securing means which can be used as a carrying strap.

5. The collapsible bracket of claim 1 wherein the upper arm and the lower arm are coated with plastic.

6. The collapsible bracket of claim 1 which is comprised of metal.

7. The collapsible bracket of claim 1 which is comprised of thermoplastic material.

8. The collapsible bracket of claim 6 wherein the metal is aluminum.

9. The collapsible bracket of claim 1 wherein the hinge end have a range of movement of approximately 180 degrees.

10. The collapsible bracket of claim 1 wherein the securing means releasably secures the bracket in the securing configuration.

11. The collapsible bracket of claim 1 wherein the securing means releasably secures the bracket in the storage configuration.

* * * * *